United States Patent [19]

Alston

[11] Patent Number: 5,021,313

[45] Date of Patent: Jun. 4, 1991

[54] IMAGE REVERSAL PROCESS

[75] Inventor: Julie M. Alston, Myrtle Bank, Australia

[73] Assignee: Stork Colorproofing B.V., Boxmeer, Netherlands

[21] Appl. No.: 424,294

[22] PCT Filed: Jan. 4, 1988

[86] PCT No.: PCT/US88/00005

§ 371 Date: Jun. 10, 1989

§ 102(e) Date: Jun. 10, 1989

[87] PCT Pub. No.: WO88/05561

PCT Pub. Date: Jul. 28, 1988

[30] Foreign Application Priority Data

Jan. 15, 1987 [AU] Australia ..... PH9884

[51] Int. Cl.[5] ..... G03G 13/09

[52] U.S. Cl. ..... 430/100; 430/42

[58] Field of Search ..... 430/100, 42

[56] References Cited

U.S. PATENT DOCUMENTS

| | | | |
|---|---|---|---|
| 4,350,749 | 9/1982 | Ohnuma et al. | 430/100 |
| 4,608,327 | 8/1986 | Oka | 430/100 |
| 4,647,182 | 3/1987 | Pierce | 430/42 |

*Primary Examiner*—John Goodrow

*Attorney, Agent, or Firm*—Myron C. Cass

[57] ABSTRACT

A process for producing a reversed image proof from a negative film separation (66) including applying a uniform toner layer (60) to an offset member (46), exposing a charged surface (20) through the film separation (66) to produce unexposed non-image areas (68) and exposed image areas (70) thereon, contacting the offset member (46) to the charged surface (20) to transfer toner (74) from the offset member (46) to the surface (20) in the non-image areas (68), leaving an image residue (76) upon the offset member (46), and contacting the offset member (46) to a receptor (49) to transfer the image (76) thereto. The process may be repeated for subsequent colors to produce a positive multicolor image and may also be adapted to conventional proofers formerly capable of producing images from positive film separations only.

30 Claims, 12 Drawing Sheets

IMAGE REVERSAL PROCESS

TECHNICAL FIELD

This invention relates to electrophotography and in particular to a novel process of preparing, by an electrophotographic process, multicolor pre-press proofs from negative color separation films and preferrably is accomplished by making appropriate adaptations to a conventional proofer device formerly capable of producing proofs from only positive color separation films.

BACKGROUND ART

The purpose of pre-press proofs, as is well known in the art, is to assess color balance and strength which can be expected from the final press run and accordingly to correct the separation transparencies before the printing plates are made therefrom. In many instances it is also required to produce so-called customer proofs for approval of subject, composition and general appearance of the print prior to press run. Thus it is essential that the pre-press proof should have the same appearance as the press print, that is to say in addition to matching the colors of the press print, the pre-press proof should be on the same paper as the press print.

On the basis of the pre-press proofs, the color separation transparencies are accepted or corrected if necessary and then used for the preparation of printing plates. There are so-called positive working and negative working printing plates, as is well known in the art. A positive working printing plate is exposed to a positive transparency or film positive wherein the information to be printed corresponds directly to opaque areas, whereas the non-printing background areas correspond to transparent areas contained on such film positive. By exposing such positive working plate to light through a film positive, the exposed areas contained thereon are rendered removable by chemical treatment and the underlying usually grained aluminum plate surface then forms the water receptive nonprinting or non-image areas, whereas the unexposed areas contained thereon form the ink receptive printing or image areas during the subsequent lithographic or offset printing.

A negative working printing plate is exposed to light through a film negative wherein the information to be printed corresponds to transparent areas, whereas the non-printing background areas correspond to opaque areas contained on such film negative. In this case the exposed areas become photo-hardened and form the ink receptive printing areas whereas the unexposed areas are removed by chemical treatment and the underlying water receptive usually grained aluminium plate surface forms the non-printing or non-image areas during subsequent lithographic or offset printing.

It is known to produce by electrophotographic processes lithographic and gravure pre-press proofs containing in general four colors, such as yellow, magenta, cyan and black. Such pre-press proofing processes are disclosed for instance in U.S. Pat. Nos. 3,337,340, 3,419,411 and 3,862,848.

It is customary to produce such electrophotographic pre-press proofs by charging a photoconductive recording member followed by exposure through a separation film positive corresponding to one color, followed by toning of the exposed photoconductor with a liquid toner of the appropriate color, followed by in-register transfer of the color toned image deposit to a receiving member surface, such as paper, usually of the same grade as the printing stock. These process steps are then repeated with separation film positives of the other three or more colors and appropriate color toners to produce a multi-color pre-press proof of print as required.

It should be noted that prior art electrophotographic pre-press proofing processes are so-called direct reproduction processes, that is to say the color separation transparencies employed include film positives wherein the image areas to be reproduced correspond directly to the opaque image areas on such film positives. Consequently in such prior art electrophotographic pre-press proofing processes the latent image formed on the photoconductor upon exposure to such positive separation films is developed by attracting thereto liquid toner material of opposite polarity to that of the electrostatic charges constituting said latent images whereby the so formed toner deposits on the photoconductor surface correspond directly to the image areas to be reproduced. Thus prior art electrophotographic pre-press proofing processes are employed only for proofing of film positives which are used for the preparation of positive working printing plates.

Prior art electrophotographic pre-press proofing processes are not suitable for the proofing of film negatives used for the preparation of negative working printing plates, in that such processes are not suitable for the reversal reproduction of imagery wherein the transparent areas contained on a film negative are to be reproduced as the image areas on the pre-press proof. Reversal reproduction per se by electrophotography is well known in the art but the processes employed for this purpose are not suitable for multicolor pre-press proofing.

Reversal image reproduction in electrophotography is normally carried out according to prior art practices by means of so-called repulsion toning. This process includes the steps of electrostatically charging the surface of a photoconductor to a polarity, typically charging an n-type photoconductor such as zinc oxide to negative polarity, exposing the surface to a film negative containing the image to be reproduced in the form of transparent areas and the non-image part in the form of opaque areas whereby the photoconductor surface becomes discharged in the exposed image areas while retaining the charge in the unexposed non-image areas and applying to the surface toner material having the same polarity as that of the charges contained on the surface, typically applying negative toner material to a negatively charged n-type photoconductor surface, whereby such toner material is repelled from the charged non-image areas onto the discharged image areas forming toner deposits thereon corresponding to the image to be reproduced. The thus formed image deposits in certain instances are fused to the photoconductor surface whereas in other instances they are transferred to a receptor sheet.

Such above described image reversal reproduction by electrophotography is very well suited to microfilm and microfiche reproduction and reader/printers wherein the information to be reproduced generally is in the form of alphanumeric characters and lines and where complete fill-in of large solid areas and complete absence of fog or stain in the non-image areas are not absolutely required. In pre-press proofing however in order to match the image quality of the press print sheet it is essential to have on the pre-press proof large solid areas completely filled in and background areas completely free of fog or stain. These requirements cannot be met by the prior art electrophotographic reversal process, because unlike by attraction toning, by repulsion toning it is not possible to produce uniformly filled in large solid areas. This is because toner repulsion from a charged background area onto an uncharged solid image area is most effective near the edges of the solid area where the intensity of the field lines from the charged background area terminating in the uncharged image area is highest. The intensity diminishes in effectiveness towards the center of the solid image area where the intensity of the terminating field lines is lowest. This results in solid image areas characterized by high density near the edges and a so-called hollow or lower density center. For the same reason, in repulsion toning the background non-image areas are completely free of fog or stain only near the edges. This so-called edge effect cannot be fully overcome even by using biasing devices during repulsion toning, that is by placing a so-called developing electrode a short distance apart from the photoconductor surface to thereby enhance toner deposition as is well known in the art.

A color proofing apparatus and method is disclosed in U.S. Pat. No. 4,556,309 ('309) whereby multicolor proofs are produced from positive color separation films only. In the method taught in the '309 patent, a photoconductor plate is uniformly charged, exposed to light through a positive transparency, toned in the image areas and the toned image deposits are transferred to an offset member and then to a receptor, such as a suitable grade of paper. In view of the above-identified advantages of producing proofs using negative transparencies and attraction toning, it would be desirable to be able to adapt a conventional proofer similar to that disclosed in the '309 patent, designed to use the positive color separation process, to convert to a negative color separation process without requiring significant changes to the proofer apparatus.

DISCLOSURE OF THE INVENTION

An image reversal process is provided for a conventional color proofer designed to produce proofs from positive color separation films, whereby the proofer may be adapted to also produce proofs from negative color separations.

In the present process, a uniform layer of a first color toner is applied to a surface of an offset web member. A photoconductor plate is charged and then exposed through a negative separation film of a first color, whereby the transparent image areas are discharged and the opaque non-image areas remain charged. The exposed photoconductor is then contacted with the offset member to receive the transfer therefrom of toner corresponding to the unexposed, non-image areas, leaving a residue on the offset member which corresponds to the exposed image areas. The residue is then transferred to a receptor such as a sheet of printing stock paper to produce thereon a positive first color image. The process may be repeated using negative separation films and corresponding toners of subsequent colors to produce a multi-colored positive image proof.

Minor modifications of the proofer components are also disclosed whereby the amount of time required to produce a positive image according to the present process is substantially reduced. The modifications include the mounting of the receptor and a toner support member on the opposite surfaces of a paper platen so that the paper platen may be rotated in the areas of the proofer adjacent the offset member. The paper platen is movable independently of the photoconductor plate to permit the steps of the present process to be carried out in rapid succession, with preparations for the next step being made before the previous step is completed.

BEST MODES FOR CARRYING OUT THE INVENTION

Figure 1:
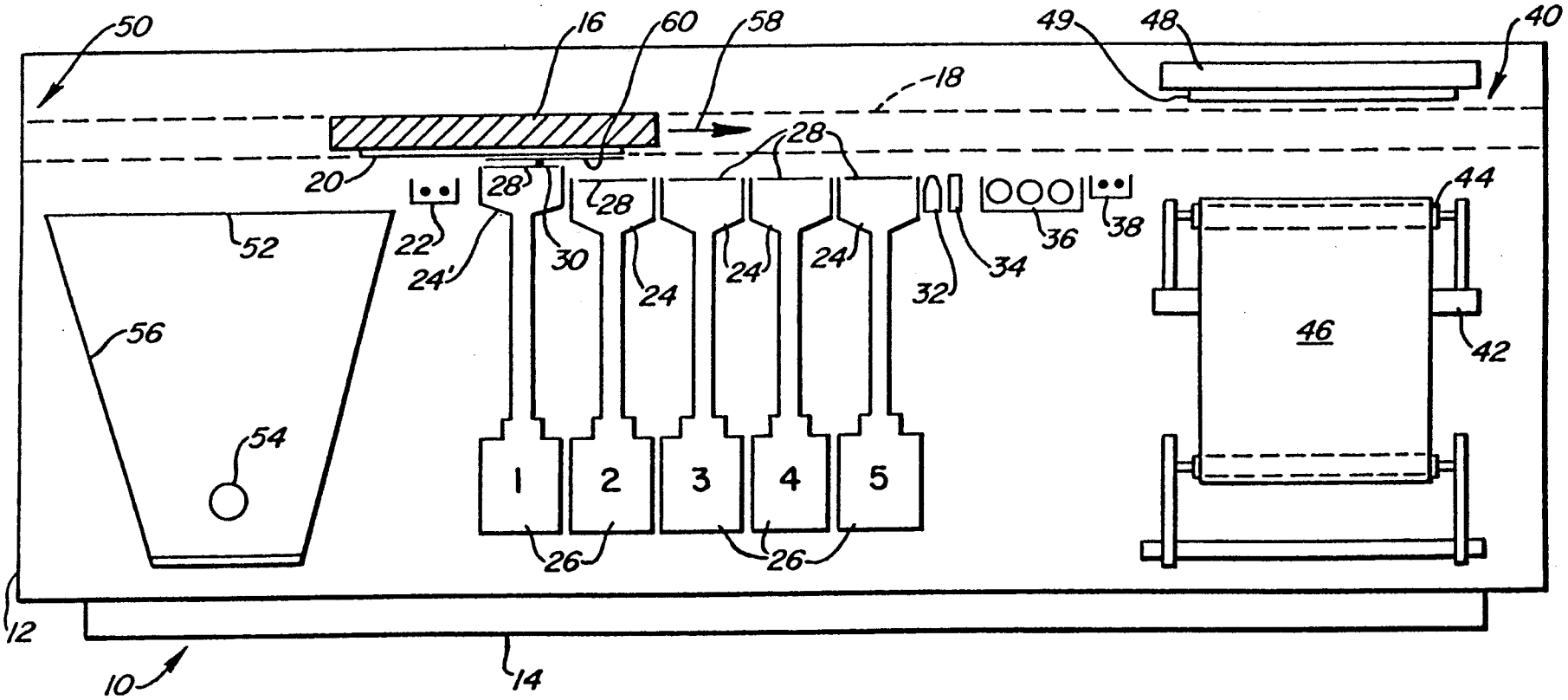
FIG. 1 is a diagrammatic side elevation in section of a color proofer capable of producing proofs according to the process of the invention, wherein the photoconductor plate is shown receiving a uniform layer of a first color toner.

Referring to FIG. 1, a sectional view of a proofer 10 is presented in diagrammatic form. The proofer 10 is preferably an automatic color proofer substantially as disclosed in U.S. Pat. No. 4,556,309 and manufactured by Coulter Systems Corporation, Bedford, Mass., U.S.A. under the designation ACP-III, however, use of the present process with suitable alternative proofers is contemplate d. The proofer 10 is provided with a housing 12 fixed to a base 14. Only the components of the proofer 10 relevant to the claimed process are shown in the drawings and described hereinbelow.

A plate platen 16 is mounted in the housing 12 for controlled lateral motion along a track 18 shown in phantom extending along the full length of the proofer 10. The platen 16 has mounted thereon a photoconductor plate 20 such as, for instance, a so-called KC plate having a metal substrate upon which is provided a photoconductive surface layer composed of inorganic crystalline sputtered cadmium sulphide. The platen 16 is shown positioned above a negative corona charger 22 and the first of five elevatable toning units 24, each connected to a corresponding toner reservoir 26 which delivers a particular color toner thereto. The toner reservoirs 26 are labeled 1–5 to indicate the color sequence of the image forming process when multiple color images are to be produced.

Each toner unit 24 is provided with a bias plate 28 for applying a bias voltage through toning gap 30 which is formed when a toning unit is elevated for toning. A conventional vacuum nozzle 32, a wetting knife 34, a cleaning unit 36 and a positive discharge corona 38 are placed in respective locations along the track 18 to be in operational proximity with the photoconductor 20.

The side of the proofer 10 shown on the right of FIGS. 1–12 is the transfer end 40, which includes a transfer elevator 42 which raises and lowers a transfer roller 44. A web-like offset member 46 is guided over the transfer roller 44. An elevatable paper platen 48 is located above the track 18 and the transfer roller 44, and has mounted thereon the receptor 49, normally a sheet of proof paper. The side of the proofer 10 shown on the left of FIGS. 1–12 and opposite the transfer end 40 is the imaging station or exposure end 50, which includes over a light source 54 within an exposure chamber 56.

It should be noted that while various types of photoconductors can be used in the process of this invention, for simplicity in the following description reference will be made with regard to polarities of an N-type, that is negatively chargeable photoconductors, such as the KC plate, and to positive polarity liquid color toners.

In one embodiment the above-identified components of the proofer 10 function in operation as follows. Referring to FIG. 1, the proofer 10 is illustrated, wherein the plate platen 16 moves along the track 18 towards the transfer end 40 in the direction indicated by the arrow 58. Prior to its engagement with the photoconductor 20, the first toner unit 24, shown as 24', is raised to operational proximity with the photoconductor 20, and the appropriate first color toner is pumped from reservoir 26(1) to flood the bias plate 2B and to film the toning gap 30.

As the photoconductor 20 reaches the toner unit 24', a positive forward bias voltage is applied between the bias plate 28 and the plate platen 16. A consequence of the application of the bias voltage is that a uniform layer 60 of the first color toner is deposited on the photoconductor 20. After deposition of the toner layer 60, the plate platen 16 proceeds along the track 18 to the transfer end 40.

It was found that to form the uniform toner layer 60 on the photoconductor 20 over a toning gap 30 of about 0.025 inch and at a toning speed in the range of 0.50 to 4.00 inch/second, preferably 0.75 to 1.50 inch/second, depending on the required layer thickness, or final image density, the forward bias voltage can be in the range of 100–500 Volts positive on the bias plate 28 in relation to the photoconductor 20.

An alternative method of forming the uniform toner layer 60 as shown in FIG. 1 is to uniformly charge photoconductor 20 by corona charger 22 preceding raised toning unit 24' as photoconductor 20 moves toward the transfer end 40. A negative reverse bias voltage may be applied during toning to bias plate 28 in raised toning unit 24' to control the thickness of the uniform toner layer 60 and consequently control the final image density.

As shown in FIG. 1, the paper platen 48 is raised to allow the plate platen 16 to move beneath it to a location adjacent the offset web 46 and the transfer roller 44.

Figure 2:
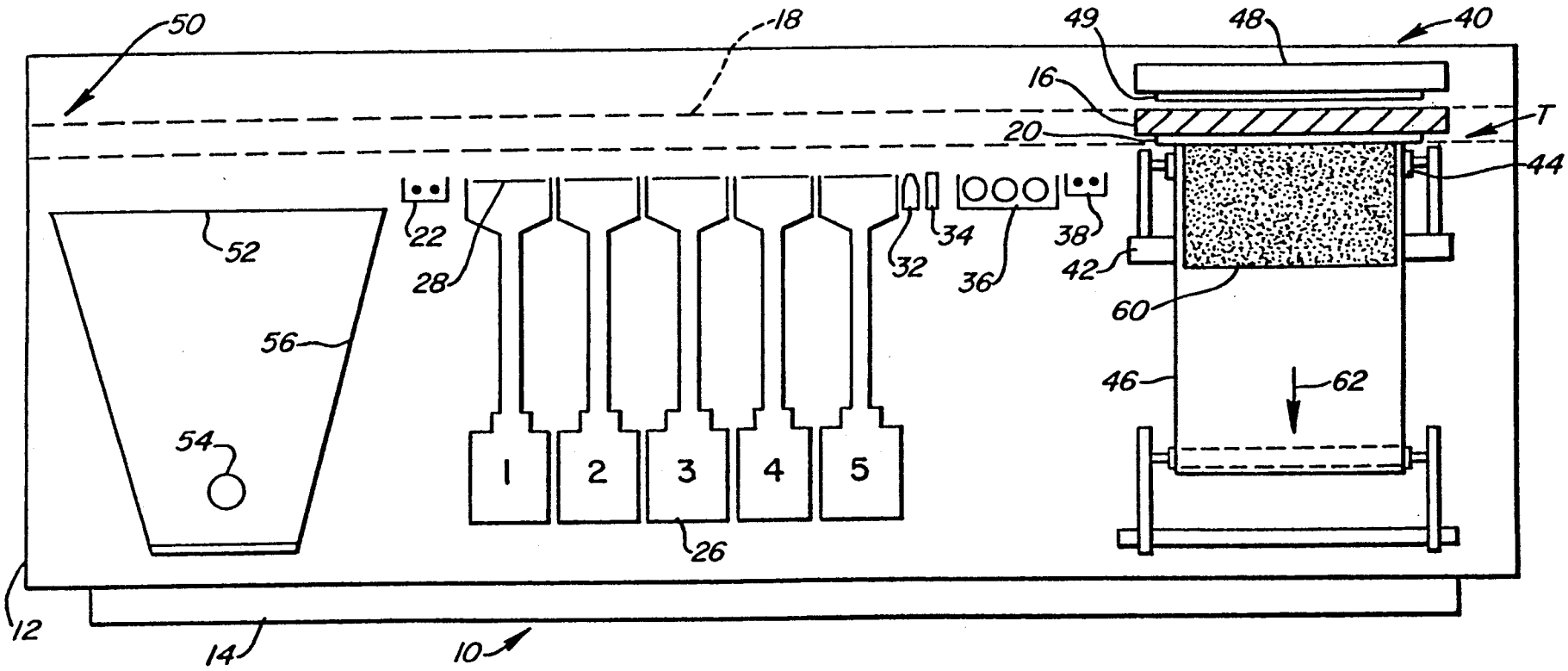
FIG. 2 is a diagrammatic side elevation in section of the proofer of FIG. 1 showing the photoconductor plate transferring the toner to an offset web member.

Referring to FIG. 2, the transfer roller 44 is raised to the transfer position 'T' by the transfer elevator 42 so that transfer of the uniform toner layer 60 to the offset web 46 is effected. The web 46 is moved in a direction indicated by the arrow 62 until the toner layer 60 is substantially transferred thereto.

The offset web 46 in accordance with this invention can be disposable or reusable. A disposable offset web 46 can be of paper, whereas the reusable type can be metal foil, or plastic film coated on the imaging side with a conductive material such as indium tin oxide or aluminum and the like or a film of dielectric material. The main requirements are that the offset web 46 should be pliable so that it can be wound over rollers and rolled over the surface of the photoconductor 20 or of the receptor 49, that it should fully release the toner layer 60 when donor or transfer toning the photoconductor 20 and then fully release the residue when transferring same to the receptor 49 as described hereinbelow. The surface of the offset web 46 should be preferably very finely grained to prevent lateral dislodgment of toner due to displacement or squeeze-out of the carrier liquid as the offset web 46 is rolled over or unrolled from the photoconductor 20 or the receptor 49 during transfer toning or transfer of residue, also described hereinbelow. If the graining of the surface is not fine enough, toner can be trapped within the grains, also the image will not be even because of reproduction of the grain pattern.

Figure 3:
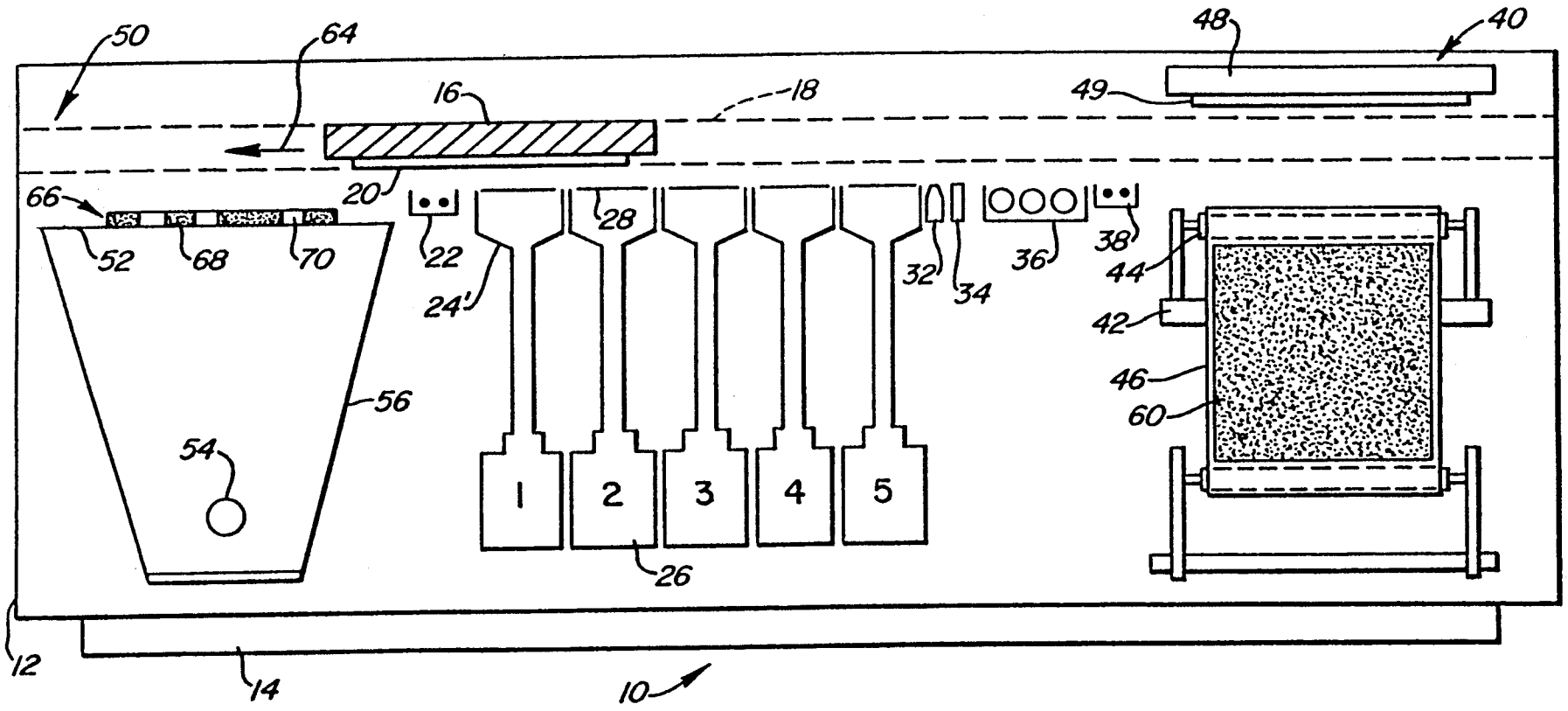
FIG. 3 is a diagrammatic side elevation in section of the proofer in FIG. 1 wherein the photoconductor plate is shown being charged prior to exposure through a negative separation film of a first color.

Referring to FIG. 3, once the toner layer 60 is transferred to the web 46, the transfer elevator 42 is lowered to allow the plate platen 16 to move along the track 18 toward the exposure end 50 in a direction indicated by the arrow 64.

During this pass, the photoconductor 20 is cleaned by the cleaning unit 36, and may be wetted with carrier liquid by the wetting knife 34 and/or dried by the vacuum nozzle 32 to remove residual toner particles as is necessary, and is then charged by the negative corona charger 22. Also during this pass, a negative film 66 for the first color is placed upon the copyboard 52. The negative film 66 includes opaque non-image or background areas 68 and transparent image areas 70.

When the plate platen 16 reaches the exposure end 50, the copyboard 52 is raised so that the negative film 66 contacts the charged photoconductor 20. A vacuum is preferably applied to ensure good contact. Exposure of the photoconductor 20 through the negative film 66 is made by the light source 54, which creates a latent image on the photoconductor 20 by discharging the plate 20 in the image areas 70.

Figure 4:
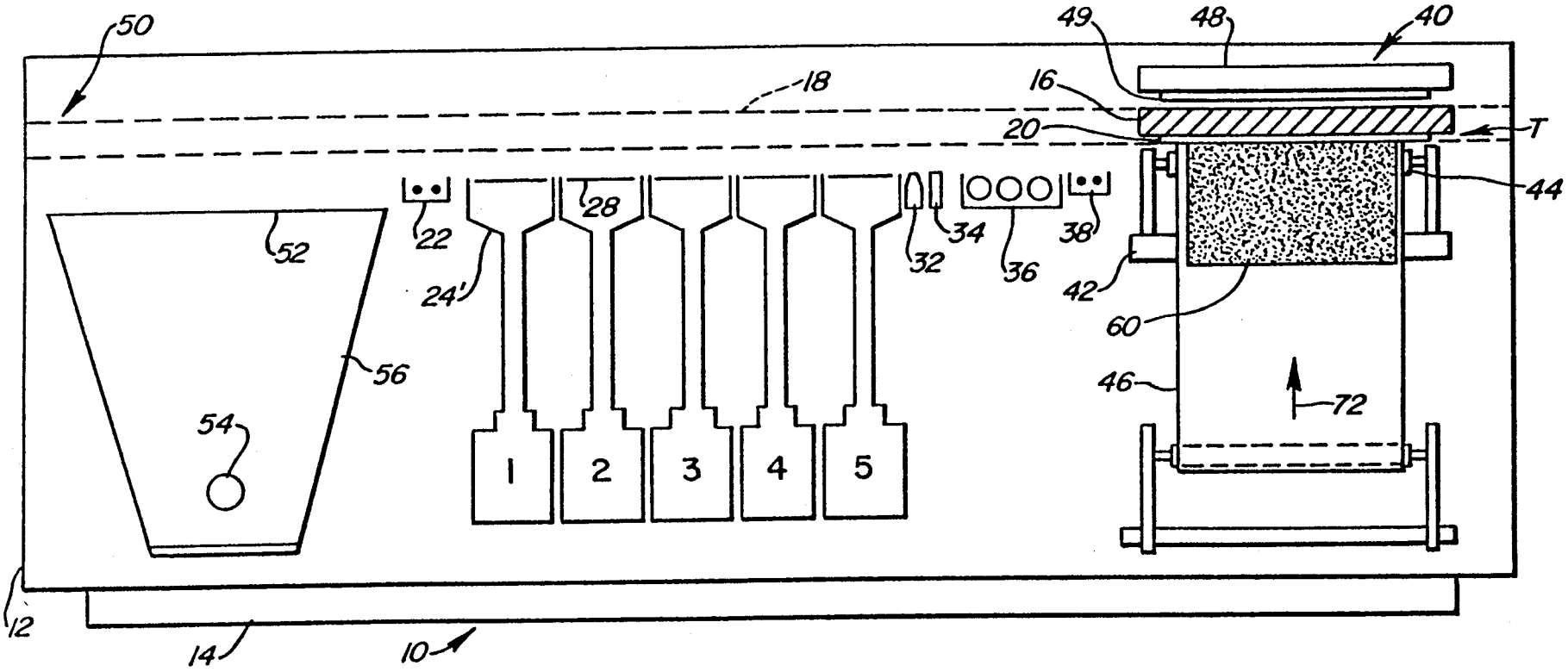
FIG. 4 is a diagrammatic side elevation in section of the proofer of FIG. 1 wherein the photoconductor plate is shown receiving toner from the offset web in the unexposed non-image areas only.

Referring to FIG. 4, following the exposure step, the exposed photoconductor 20 moves toward the transfer end 40. The transfer elevator 42 is then raised to the transfer position "T", wherein the offset web 46 is moved in the direction indicated by the arrow 72. In this step, the exposed photoconductor 20 is transfer or donor toned by the uniform toner layer 60 on offset web 46. The transfer toning preferably is accomplished by applying a voltage during toning between the plate platen 16, that is to say the photoconductor 20 on the conductive backing, and the transfer roller 44 behind the offset member 46 or the offset member 46 itself if it is conductive. It will be seen presently that the photoconductor 20 only receives toner corresponding to the unexposed non-image areas 68.

If the surface voltage forming the latent images on the photoconductor 20 is about 24–30 Volts, it was found that the transfer or donor toning voltage can be in the range of about 1,000 Volts negative to 100 Volts positive, depending on the nature of the offset web 46, the conductivity of the transfer roller 44 and toning speed. Using for instance 100 microns thick coated art paper as offset web 46 at a toning speed in the range 1.0 to 3.0 inch/second, with a polyurethane coated transfer roller 44, the toning voltage was in the range 10 to 60 Volts positive on the transfer roller 44 in relation to the plate platen 16, that is to say, in relation to the photoconductor 20 on a conductive backing, whereas with a fully conductive transfer roller 44 the range was 5 to 25 Volts positive. It will be noted that this is forward biasing, in that the positive toner is repelled from the offset web 46 and urged towards the negative latent images on the photoconductor 20.

If the offset web member 46 is a metal foil or a plastic film such as polyester having on its imaging side a conductive coating of for instance indium tin oxide, the voltage for transfer toning is applied directly between the plate platen 16 and the metal foil or the conductive coating on the polyester film, and in these cases the conductivity of the transfer roller 44 behind such foil or polyester film is of no consequence. In these instances, at a toning speed in the range 1.0 to 2.0 inch/second, it was found that the voltage was in the range 0 to 50 Volts negative on the conductive offset member 46 in relation to the plate platen 16. It will be noted that this is reverse biasing, in that the positive toner is retarded by the offset web 46 in moving towards the negative image charges on the photoconductor.

With an offset web member 46 comprising a 100 microns thick dielectric film of polyester, having a surface resistivity of $7.1 \times 10^{11}$ ohmcm on its imaging side, at a toning speed in the range of 1 to 2 inch/second, with a polyurethane coated transfer roller 44 the toning voltage was in the range of 750 to 1000 Volts negative on the transfer roller 44 in relation to the plate platen 16, whereas with a fully conductive transfer roller the range was 300 to 500 Volts negative. It will be noted that this is again reverse biasing.

Figure 5:
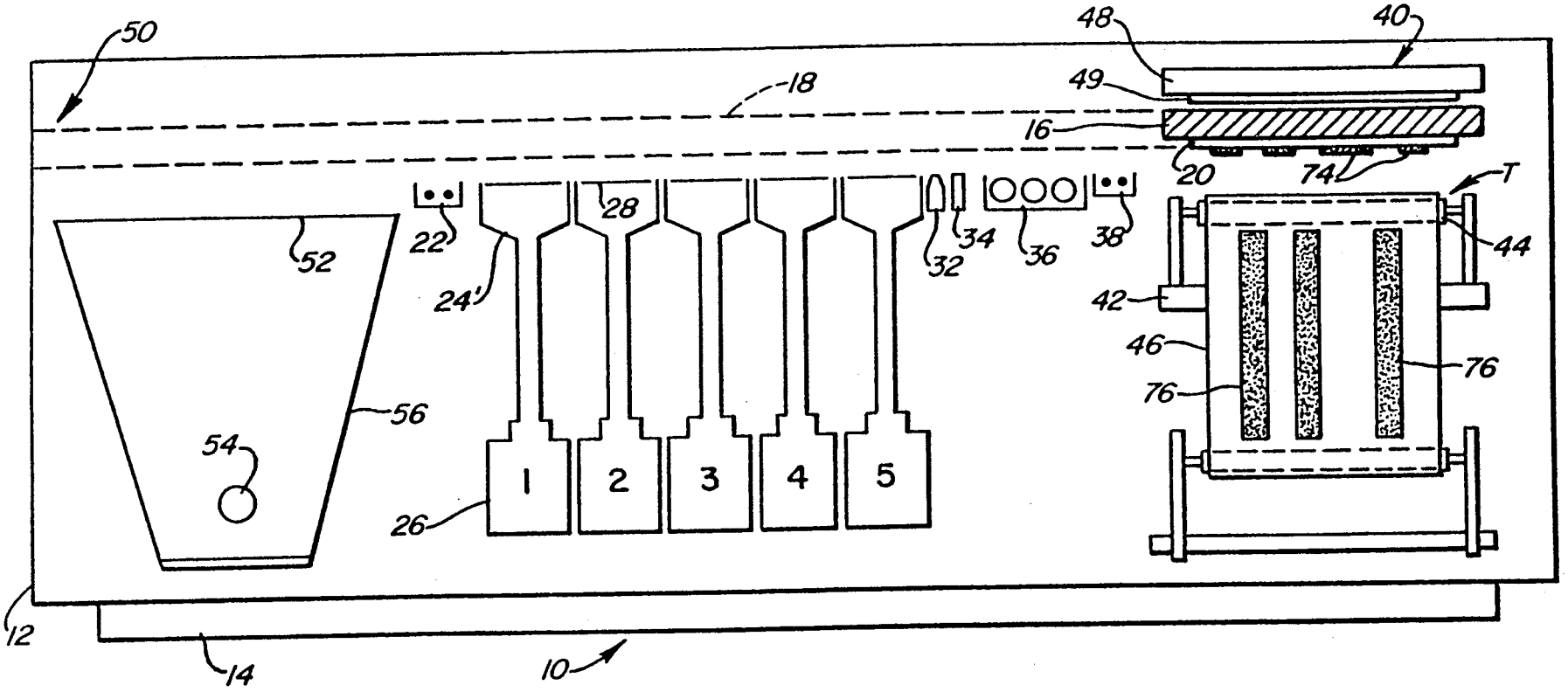
FIG. 5 is a diagrammatic side elevation in section of the proofer of FIG. 1 wherein the photoconductor plate is shown after removal of toner corresponding to the non-image areas from the offset web, leaving a residue thereon corresponding to the image areas.

Referring to FIG. 5, after the transfer of toner to the photoconductor 20 is accomplished, the elevator 42 is lowered and the offset web 46 is rewound. It is seen that the photoconductor 20 contains the toner deposit 74 corresponding to the unexposed non-image areas 68 of the negative film 66 and the web 46 retains the toner residue 76 corresponding to the exposed image areas 70 of the negative film 66.

Figure 6:
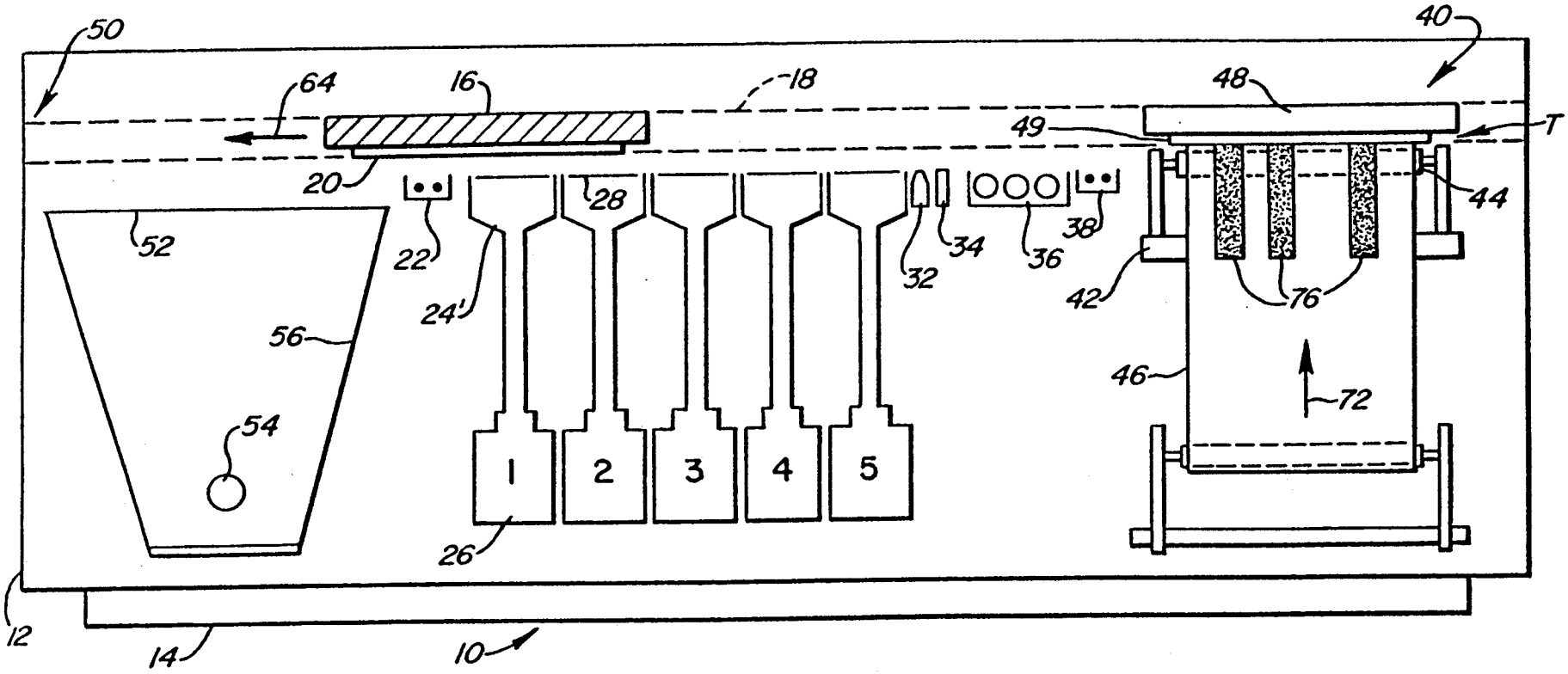
FIG. 6 is a diagrammatic side elevation in section of the proofer of FIG. 1 wherein the offset web is shown transferring the residue corresponding to the image areas to a receptor.

Referring to FIG. 6, the plate platen 16 moves in direction 64 toward the exposure end 50. Any residual charges on the photoconductor 20 are removed by the positive discharge corona 38. The platen 16 then engages the cleaning unit 36, the wetting knife 34 and the vacuum nozzle 32 as necessary to remove residual toner deposits 74 from the photoconductor 20. Once the platen 16 has moved from the transfer position 'T', the paper platen 48 is lowered to the transfer position 'T', the elevator 42 is raised, and the web 46 is moved in the direction indicated by the arrow 72 to transfer the residue 76 to the receptor 49, and the production of the first color image is complete. The plate platen 16 is then placed in position to receive the second color toner as described previously herein in regard to FIG. 1.

An alternative method of cleaning the photoconductor 20 after the platen 16 moves toward the exposure end 50 is to discharge the residual charges on the photoconductor 20 with the discharge corona 38, and move the platen 16 to the exposure end 50 without engaging the cleaning unit 36, the wetting knife 34 and the vacuum nozzle 32. Instead, the platen 16 is placed adjacent the first toner unit 24' as shown in FIG. 1, the toner unit 24' is raised to the toning position, the toning gap 30 is refilled with toner from the reservoir 26 and the platen 16 is moved toward the transfer end 40 while applying a reverse bias voltage between the bias plate 28 and the platen 16 to remove toner deposits from the photoconductor 20 and retain the toner in the toning unit 24'. Once the platen 16 reaches the transfer end 40, it moves back toward the exposure end 50, during which pass the photoconductor 20 is cleaned by the cleaning unit 36, wetted by the knife 34 and vacuumed by the vacuum nozzle 32. The advantages of this alternative method is reduced contamination of the cleaning unit 36 with toner.

Figure 7:
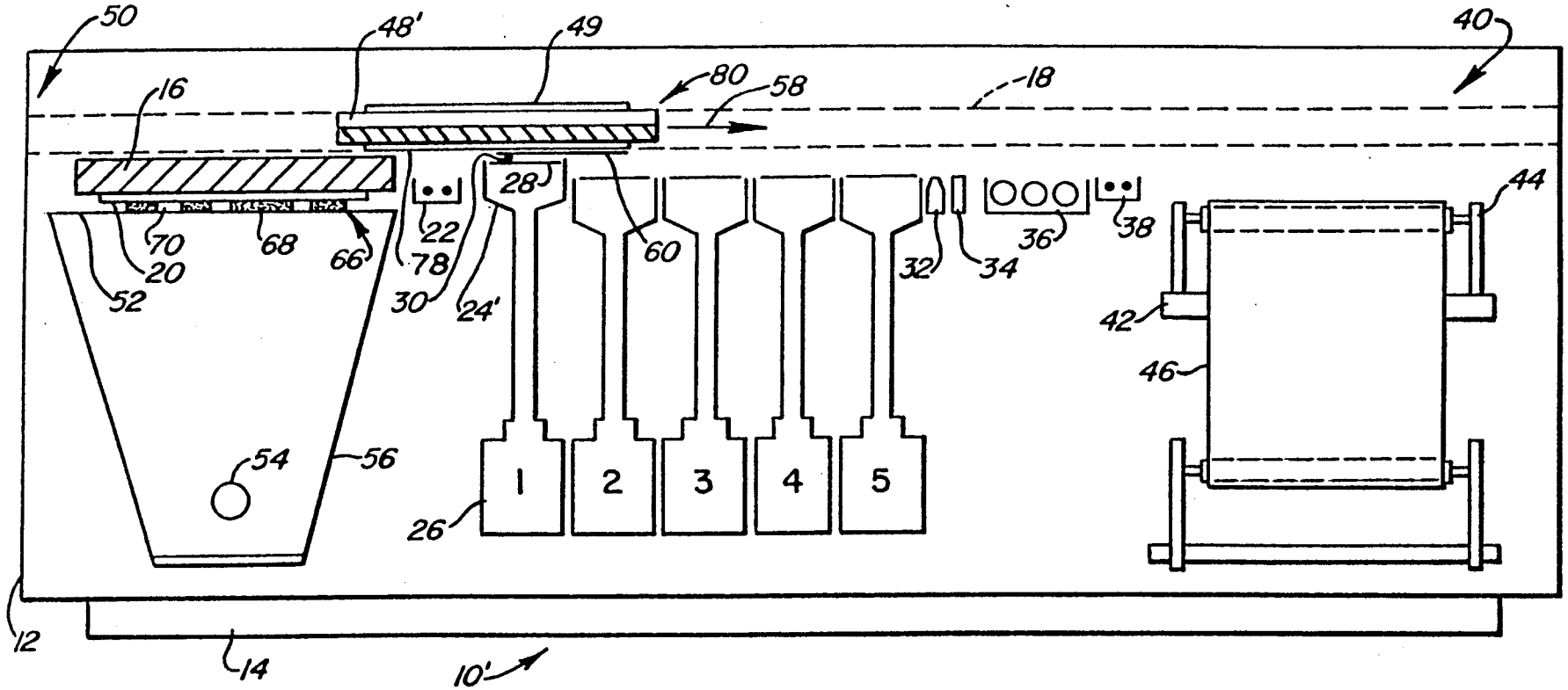
FIG. 7 is a diagrammatic side elevation in section of an alternate embodiment of the proofer of FIG. 1 shown modified so that the receptor and a toner support member are mounted on opposite surfaces of the paper platen which is movable from a toning position to an offset web transfer position; the paper platen is shown as it moves toward the transfer position and a uniform toner layer is being applied to the toner support member mounted on the lower surface thereof.

Referring now to FIGS. 7–12, in a further embodiment an alternative image forming process is disclosed for applications in which proofs must be produced relatively more rapidly than the process described in relation to FIGS. 1–6. FIG. 7 discloses a proofer 10' shown in diagrammatic form in similar fashion to the proofer 10 shown in FIGS. 1–6, and similar components are indicated by corresponding reference numerals.

The proofer 10' is distinguishable from the proofer 10 in that a paper platen 48' has mounted on one side thereof the receptor 49 and on its other side a support member 78 for the uniform toner layer 60. The paper platen assembly 80, including the paper platen 48', the receptor 49 and the support member 78, and the independently movable platen 16 are both movable along the entire length of the proofer 10' along the track 18.

The plate platen 16 is designed to be lowered at the exposure end 50 for contact exposure and to allow the assembly 80 to move above it.

The assembly 80 is further designed to rotate so that either the receptor 49 or the support member 78 may be lowermost for operational contact with the components at the transfer end 40 and also to be raised at the transfer position 'T' to permit the plate platen 16 to move beneath it to reach the transfer position 'T'.

The copyboard 52 is fixed within the housing 12, and may be located lower therein than described in relation to FIGS. 1-6. Referring to FIG. 7, the plate platen 16 is charged by the negative corona charger 22 and is placed above and in contact with the negative film 66 on the copyboard 52 for exposure as described hereinabove. At the same time, the assembly 80 with the support member 78 lowermost, having been moved toward the exposure end 50 over the lowered plate platen 16, is shown moving towards the transfer end 40 in the direction indicated by the arrow 58. The support member 78 encounters the first toner unit 24' to have a uniform toner layer 60 formed thereon in similar fashion to the photoconductor 20 of FIG. 1.

The support member 78 may be a metal plate onto which toner is deposited by applying a forward bias voltage to the bias plate 28 during toning as paper platen 48' moves over toning unit 24' toward transfer end 40. Alternatively, the support member 78 may be another photoconductor, similar to the plate 20 described in relation to FIGS. 1-6, or a dielectric material on a conductive backing, in which case the photoconductor or the dielectric material is charged by the negative corona charger 22 prior to toning. The voltage applied to the bias plate 28 may be for forward or reverse biasing, as necessary to control the thickness of the toner layer 60. If the support member 78 is a photoconductor, the uniform toner layer 60 can be formed thereon as described hereinabove. If the support member 78 is fully conductive, such as a metal plate, it was found that to form a uniform toner layer 60 thereon over a toning gap 30 of about 0.025 inch, and at a toning speed in the range given above, depending on the layer thickness required, the forward bias voltage can be also in the range 100-500 Volts positive on the bias plate 28 in relation to the support member 78. If the support member 78 is dielectric, such as for instance a polyester film preferably having a conductive coating of for instance indium tin oxide or aluminum on the side of which is in electrical contact with the paper platen 48', it was found that the uniform toner layer 60 can be formed thereon by charging it prior to toning to a surface voltage in the range of 500-3,000 Volts, again depending on the required thickness of the layer 60.

Figure 8:
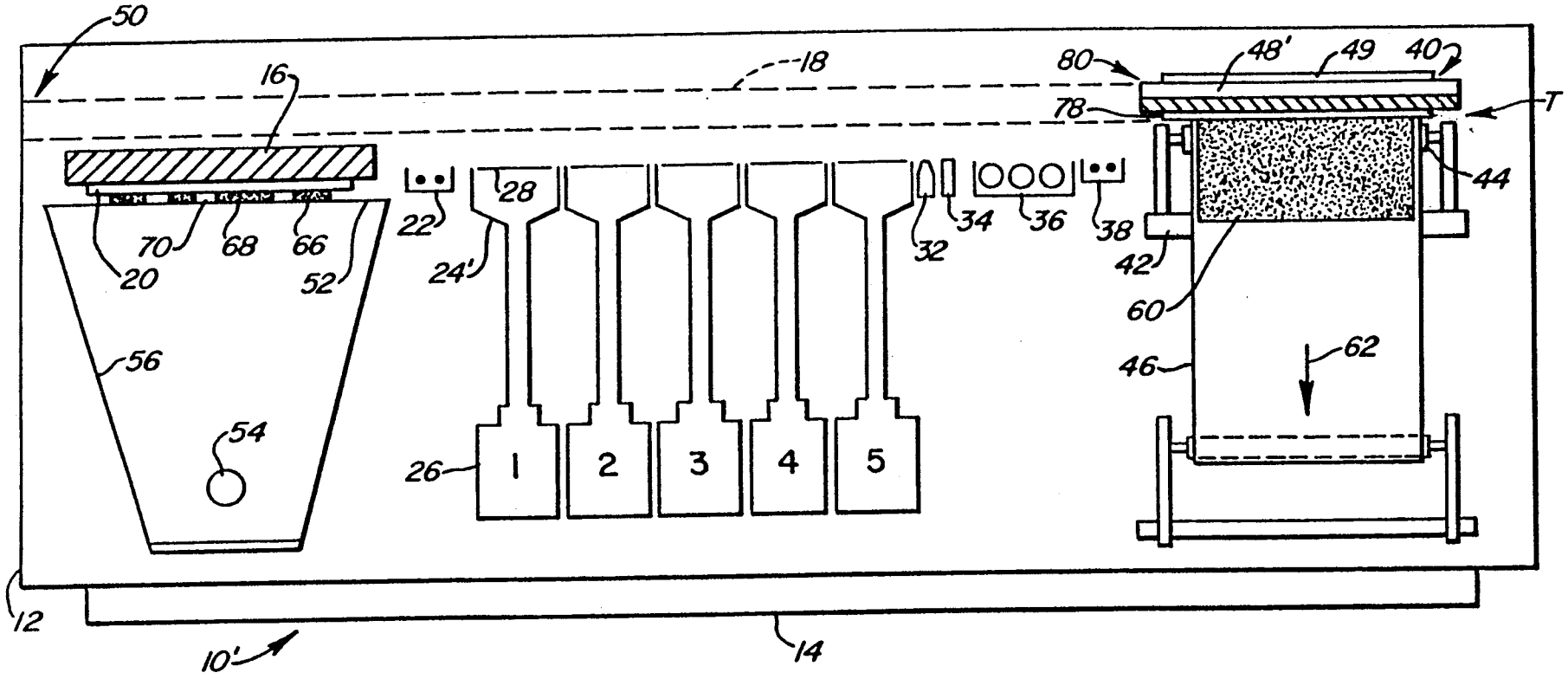
FIG. 8 is a diagrammatic side elevation in section of the proofer of FIG. 7 wherein the toner support member is shown transferring a uniform toner layer to the offset member, while the photoconductor plate is exposed through a negative separation film of a first color.

Referring to FIG. 8, once the assembly 80 reaches the transfer end 40, the transfer elevator 42 is raised to the transfer position 'T' and the uniform toner layer 60 is transferred from the support member 78 to the web 46. During transfer, the web 46 is moved in the direction indicated by the arrow 62. The photoconductor 20 on the plate platen 16 is still being exposed by the light source 54 through the first color negative film 66 and the first color toning unit 24 has been lowered.

Figure 9:
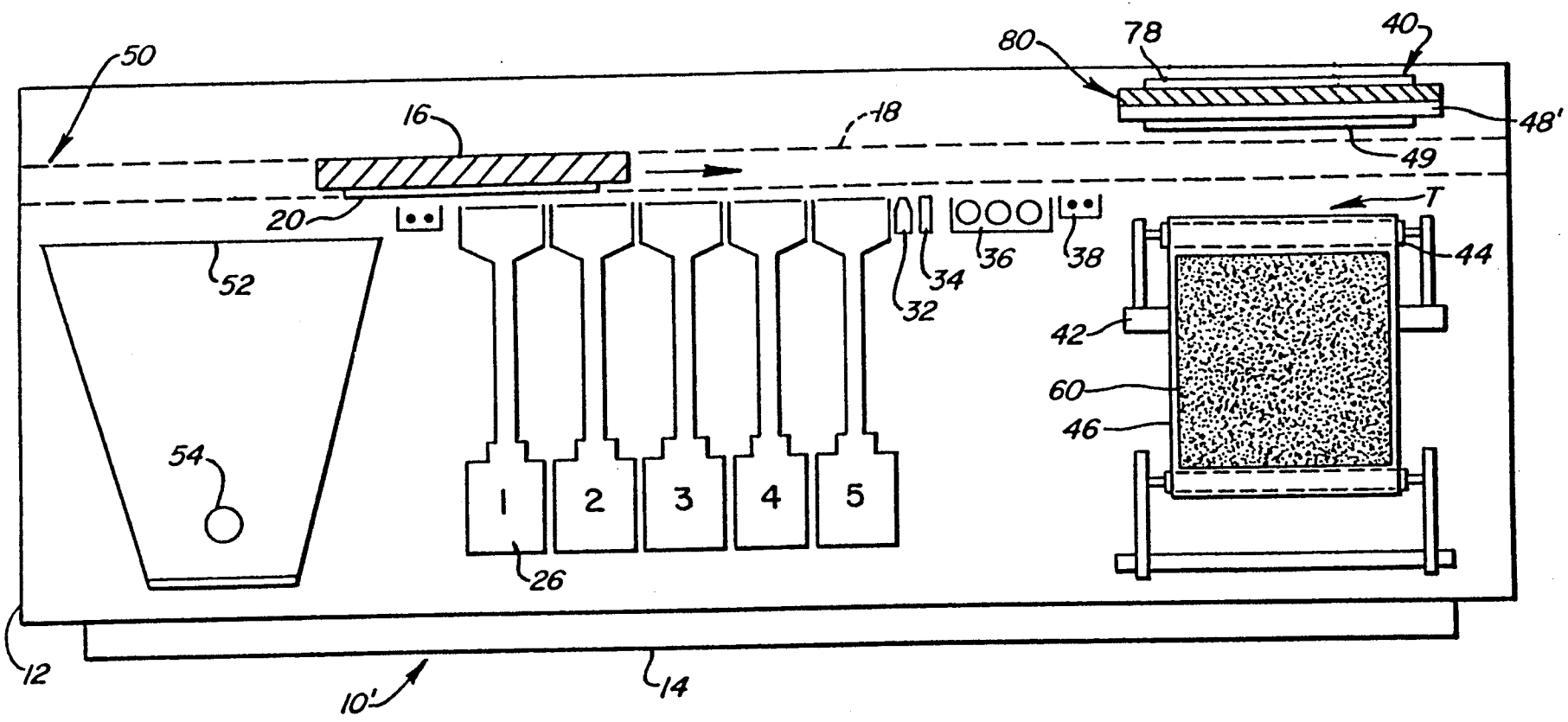
FIG. 9 is a diagrammatic side elevation in section of the proofer of FIG. 7 wherein the exposed photoconductor plate is shown moving toward the toned offset web and the paper platen has been rotated so that the receptor is now on the lower surface thereof.

After exposure is completed, and referring to FIG. 9, the assembly 80 is raised to permit the plate platen 16, which is moving toward the transfer end 40, to access the transfer position 'T'. At the same time the offset web 46 has received the uniform toner layer 60, the transfer elevator 42 has been lowered and the assembly 80 has been rotated so that the receptor 49 is lowermost. The support member 78 is uppermost where it can be cleaned either manually or automatically.

Figure 10:
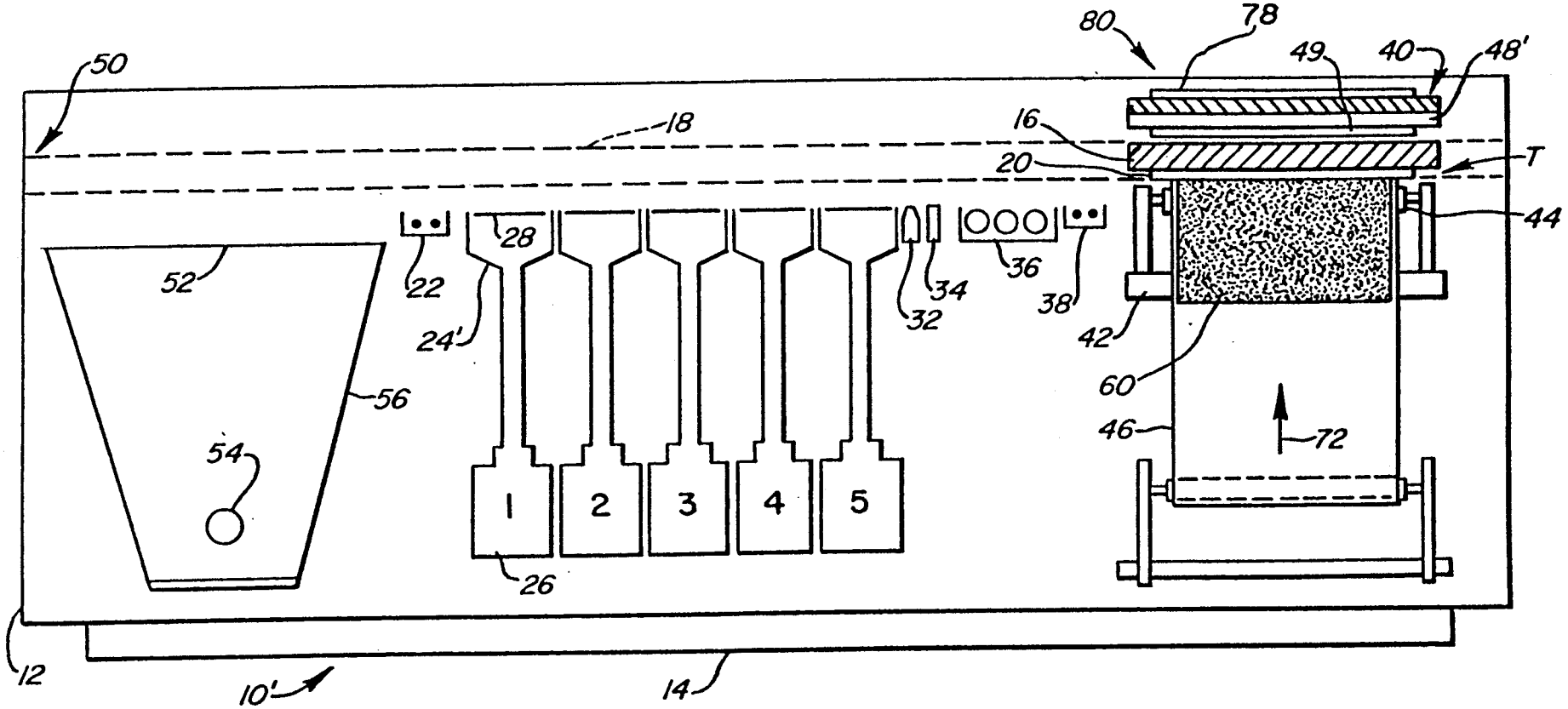
FIG. 10 is a diagrammatic side elevation in section of the proofer of FIG. 7 wherein the exposed photoconductor plate is shown receiving toner from the offset web in the non-exposed, non-image areas.
Figure 11:
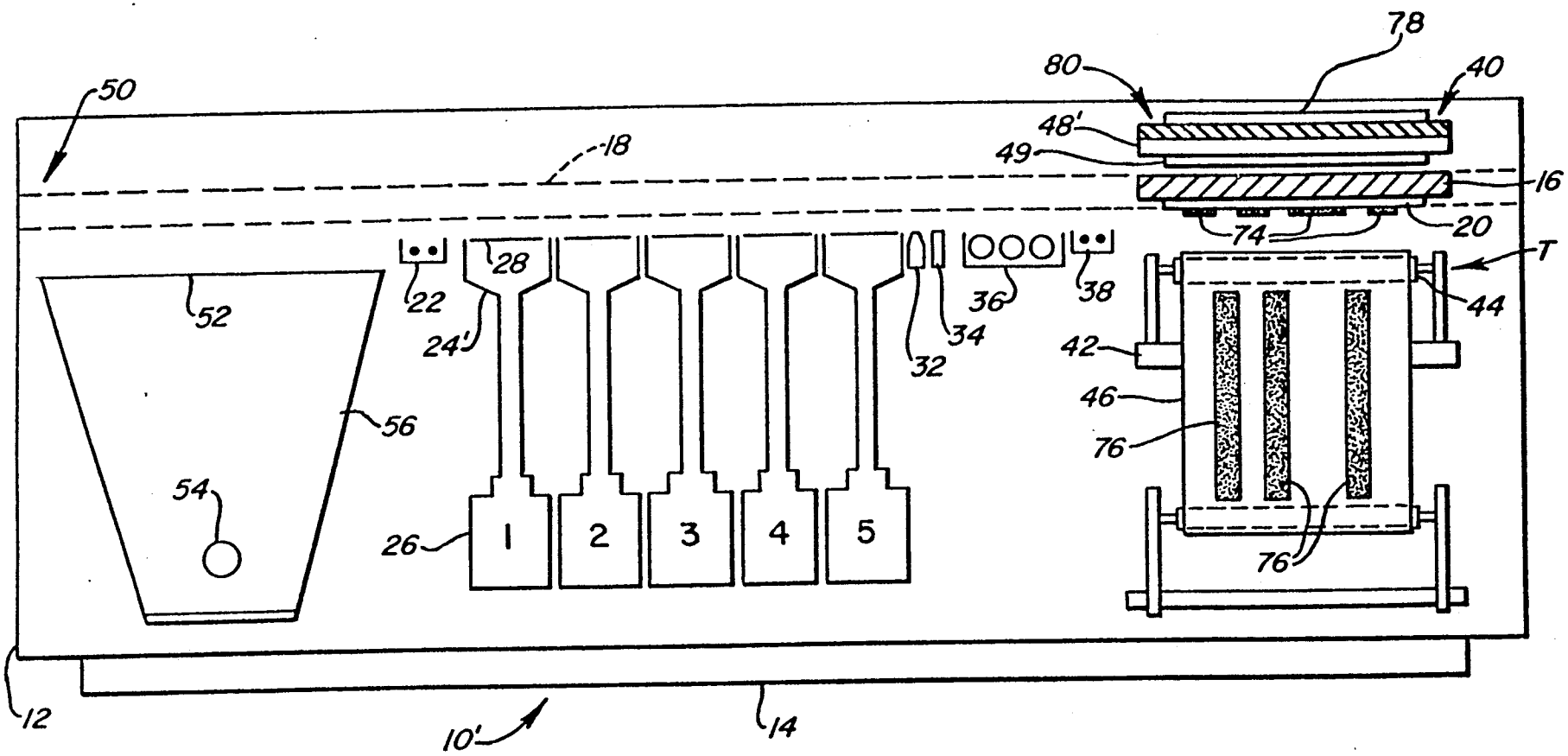
FIG. 11 is a diagrammatic side elevation in section of the proofer of FIG. 7 wherein the photoconductor plate is shown after removal of the non-exposed, non-image areas, leaving a residue on the offset web corresponding to the exposed image areas.

Referring to FIG. 10, once the charged photoconductor 20 reaches the transfer end 40, the transfer elevator 42 is raised to the transfer position 'T' and the offset web 46 is rewound in the direction indicated by the arrow 72 to transfer tone the photoconductor 20. In FIG. 11, it will be seen that after transfer toning the photoconductor 20, only non-image toner deposits 74 are contained thereon, while the image residues 76 remain on the web 46. The web 46 is rewound prior to transfer to the paper platen 48' and the receptor 49.

Figure 12:
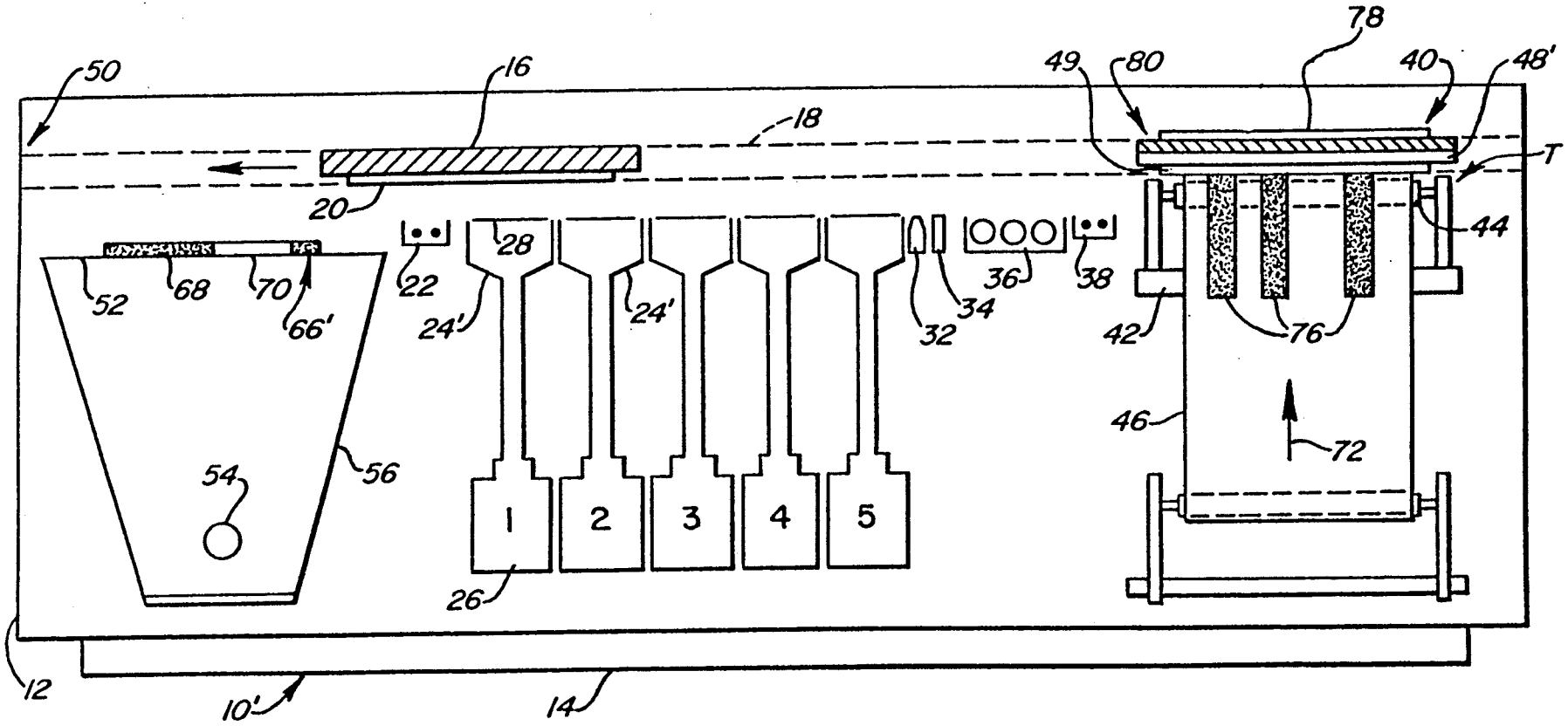
FIG. 12 is a diagrammatic side elevation in section of the proofer of FIG. 7 wherein the offset web is shown transferring the residue corresponding to the image areas to a receptor, while the photoconductor plate is recharged for exposure through a negative separation film of a second color.

Referring to FIG. 12, the plate platen 16 moves toward the exposure end 50, and during this pass it is discharged by the positive corona 38 and may be cleaned by the procedure described hereinabove in relation to the description of FIG. 6. At the same time, the paper platen 48' is lowered to the transfer position 'T', the transfer elevator 42 is raised and the web 46 moves in the direction indicated by the arrow 72 to transfer the residue 76 to the receptor 49. This completes the transfer of the first color image. Also at this time, the negative film 66' for the second color is placed on the copyboard 52. As the photoconductor 20 returns from the transfer end 40, it is recharged by the corona charger 22 in preparation for the exposure through the second color negative film 66'. The assembly 80 with the support member 78 lowermost moves toward the exposure end 50 for repetition of the process as described in relation to FIGS. 7-12.

The use of reverse bias voltage to alter the thickness of the uniform toner layer 60 as described hereinabove in relation to the first embodiment may be equally applied to the embodiment described in relation to FIGS. 7-12.

In the above embodiments, appropriate devices are provided to ensure precise registration between the color separation films, 66, 66', etc., the photoconductor 20, the support member 78 where applicable, the offset web 46 and the receptor 49.

It should be noted that in the above described embodiments certain ancillary process steps can be included if so desired, which include for instance removing by vacuum loosely held toner particles or liquid toner or carrier liquid remaining on the photoconductor 20 or support member 78 after formation of the uniform toner layer 60 thereon and re-wetting same with carrier liquid prior to transfer of the uniform toner layer 60 to the offset web 46, pre-wetting the offset web 46 with carrier liquid prior to transfer of a uniform toner layer 60 thereto, wetting the charged and exposed photoconductor 20 prior to transfer toning same, rewetting the offset web 46 thereafter, pre-wetting the receptor 49 prior to transfer thereto of the toner residue 74 and drying same thereafter, and the like.

A further ancillary step which may be found useful in above embodiments includes so-called pre-rolling. This means for instance in the step of transferring the residue 74 from the offset web 46 to the receptor 49 that in the first pass in one direction the offset web 46 is rolled over the receptor 49 to make good contact therewith while a so-called holding voltage is applied having a polarity which prevents transfer, and then transfer is effected in a second pass in the opposite direction whilst the transfer voltage having the opposite polarity is applied and the offset member is unrolled from the receptor. Such pre-rolling may be also applied to the steps of transferring the uniform toner layer 60 from the photoconductor 20 or the support member 78 to the offset web 46 and to the step of transfer toning the photoconductor 20 by the offset web 46.

It will be realized that a proofer 10 or 10' producing positive proofs from negative color separation films in accordance with any of the above embodiments, by a simple program change can virtually immediately produce positive proofs from positive color separation films, where the photoconductor 20 is charged, exposed to a positive film 66 and toned to form image deposits 76 thereon, which are transferred to the offset web member 46 and then to the receptor 49.

While preferred embodiments of the invention have been shown, it will be understood that the invention may be otherwise embodied within the scope of the appended claims. Minor variations in the structure and in the arrangement and size of the various parts may occur to those skilled in the art without departing from the spirit and scope of the invention.

I claim:

1. A method of producing a positive image proof from a negative film separation in a colorproofer having a photoconductor plate which is mounted on the lower surface of a plate platen and is adapted to move over a charging station, an exposure station, toning units containing toners of different colors and bias plates for applying a bias voltage, vacuum suction means, wetting means, and a transfer station, and having a receptor sheet which is mounted on the first surface of a paper platen for image transfer thereto in said transfer station, said paper platen being optionally adapted to be turned over and to move over said toning units for toning a support member mounted on its second surface, said transfer station containing an offset member adapted to transfer thereto from said photoconductor and optionally from said support member on said second surface of said paper platen, and to transfer therefrom onto said receptor on the first surface of said paper platen, comprising the steps of:

A. depositing a uniform toner layer of a first color onto said offset member,

B. charging said photoconductor,

C. exposing said photoconductor to a negative film separation of said first color to thereby form exposed image and unexposed non-image areas thereon, D. contacting said photoconductor with said offset member to transfer said toner therefrom to said unexposed areas of said photoconductor to thereby form a toner residue on said offset member corresponding to said exposed image areas, and E. transferring said toner residue from said offset member to said receptor to produce thereon a positive first color image.

2. The method of claim 1, further including repeating steps A–E with negative separation films of subsequent colors in register with each other and corresponding color toners to produce a multi-color proof upon said receptor.

3. The method of claim 1 wherein deposition of said uniform toner layer of a first color onto said offset member is by transfer thereto of a uniform toner layer formed on said photoconductor.

4. The method of claim 3 wherein said uniform toner layer on said photoconductor is formed by applying a forward bias voltage between said photoconductor and the bias plate in the first color toning unit.

5. The method of claim 3 wherein said uniform toner layer on said photoconductor is formed by uniformly charging said photoconductor and then toning same in the first color toning unit.

6. The method of claim 3 further including applying a reverse bias voltage between the uniformly charged photoconductor and the bias plate in the first color toning unit to thereby control the thickness of the uniform toner layer formed thereon.

7. The method of claim 3 further including cleaning and rewetting said photoconductor with said vacuum suction means and said wetting means after said deposition of toner of step A is accomplished.

8. The method of claim 1 wherein deposition of said uniform toner layer of a first color onto said offset member is by transfer thereto of a uniform toner layer formed on said support member mounted on said second surface of said paper platen.

9. The method of claim 8 wherein said support member comprises a conductive material and said uniform toner layer is formed thereon by applying a forward bias voltage between said support member and the bias plate in the first color toning unit.

10. The method of claim 8 wherein said support member is a dielectric material and said uniform toner layer is formed thereon by uniformly charging said support member and then toning same in the first color toning unit.

11. The method of claim 10 further including applying a reverse bias voltage between the uniformly charged dielectric support member and the bias plate in the first color toning unit to thereby control the thickness of the uniform toner layer formed thereon.

12. The method of claim 8 wherein said paper platen moves with its second surface lowermost over said toning units for the formation of said uniform toner layer on said support member contained thereon and then moves to said transfer station for transfer of such toner layer onto said offset member, and following the formation of said toner residue on said offset member said paper platen is turned over so as to have its first surface with said receptor lowermost for transfer thereto of said residue from said offset member.

13. The method of claim 1 further including discharging said photoconductor after said toner residue is removed therefrom.

14. The method of claim 13 further including removing any remaining first color toner deposit on said photoconductor.

15. The method of claim 14 wherein said toner is removed by a scraper blade.

16. The method of claim 14 wherein said toner is removed by electrostatic transfer to a roller.

17. The method of claim 14 wherein said toner is removed by a vacuum nozzle of said vacuum means.

18. The method of claim 14 wherein said photoconductor is air dried after the removal of said first color toner therefrom.

19. The method of claim 13 further including locating said photoconductor above a toner unit and applying a reverse bias voltage thereto so that said toner residue is deposited in said toner unit.

20. The method of claim 19 including further cleaning said photoconductor by cleaning with a cleaning unit, wetting said surface with said wetting means and vacuuming said surface with said vacuum means.

21. The method of claim 1 further including contacting said offset member with said receptor and applying a holding voltage thereto to prevent transfer of said toner, then applying a second transfer voltage thereto to effect transfer of said toner to said receptor.

22. The method of claim 1 further including contacting said photoconductor with said offset member and applying a holding voltage thereto to prevent deposit of said toner, then applying a second transfer voltage to effect transfer of said toner to said offset member.

23. The method of claim 1 wherein prior to said transfer toning of said photoconductor, a holding voltage is applied to said photoconductor and offset member, then a second transfer voltage is applied to effect transfer of said non-image residue.

24. The method of claim 1 further including practicing said steps in overlapping fashion, i.e., beginning a step prior to the completion of a previous step.

25. The method of claim 1 further including prewetting said offset member with carrier liquid prior to the deposit of said toner layer thereon.

26. The method of claim 1 further including wetting said exposed photoconductor with carrier liquid prior to transferring said toner in said non-image areas thereto.

27. The method of claim 1 further including rewetting the offset member with carrier liquid subsequent to the transfer of said non-image toner residue to said photoconductor.

28. The method of claim 1 further including prewetting said receptor with carrier liquid prior to transfer of said image thereto and drying said receptor subsequent to said transfer.

29. A method of producing a positive image proof from a negative film separation in a colorproofer having a photoconductor plate which is mounted on the lower surface of a plate platen and is adapted to move over a charging station, an exposure station, toning units containing toners of different colors and bias plates for applying a bias voltage, vacuum suction means, wetting means, and a transfer station, and having a receptor sheet which is mounted on the first surface of a paper platen for image transfer thereto in said transfer station, said paper platen being optionally adapted to be turned over and to move over said toning units for toning a support member mounted on its second surface, said transfer station containing an offset member adapted to transfer thereto from said photoconductor and optionally from said support member on said second surface of said paper platen, and to transfer therefrom onto said receptor on the first surface of said paper platen, comprising the steps of:

A. uniformly depositing a toner deposit upon a photoconductor by attraction toning with a first color toner by applying a reverse bias voltage between said surface and a bias plate;

B. transferring said toner deposit from said photoconductor to an offset web member;

C. cleaning and drying said photoconductor;

D. charging said photoconductor;

E. exposing said photoconductor to a first color negative film separation having transparent image areas and opaque non-image areas, wherein said photoconductor is discharged in said image areas;

F. contacting said photoconductor with said offset web and applying an appropriate voltage thereto to transfer the toner from said offset web to the still charged non-image areas on said photoconductor;

G. contacting said offset web with a receptor to transfer said image areas thereto; and H. discharging said photoconductor and removing said toner therefrom.

30. The method of claim 29, further including repeating said method for each additional color required for the final proof.

* * * * *

UNITED STATES PATENT AND TRADEMARK OFFICE

CERTIFICATE OF CORRECTION

PATENT NO. : 5,021,313

DATED : June 4, 1991

INVENTOR(S) : Julie M. Alston

It is certified that error appears in the above-identified patent and that said Letters Patent is hereby corrected as shown below:

Column 5, line 64, change "2B" to --28--.

Column 5, line 64, change "film" to --fill--.

Signed and Sealed this

Twentieth Day of October, 1992

*Attest:*

DOUGLAS B. COMER

*Attesting Officer*

*Acting Commissioner of Patents and Trademarks*